United States Patent [19]

Koch

[11] 4,039,460

[45] Aug. 2, 1977

[54] HYDROXYALKYL-AMINOBUTYRIC ACID LUBRICANTS FOR THE COLD-WORKING OF ALUMINUM

[75] Inventor: Karlheinz Koch, Haan, Germany

[73] Assignee: Henkel & Cie G.m.b.H., Dusseldorf, Germany

[21] Appl. No.: 521,245

[22] Filed: Nov. 6, 1974

[30] Foreign Application Priority Data

Nov. 10, 1973 Germany ..... 2356322

[51] Int. Cl.[2] ..... C07C 101/30

[52] U.S. Cl. ..... 252/49.3; 72/42; 260/534 M

[58] Field of Search ..... 260/534 M; 72/42; 252/49.3

[56] References Cited

U.S. PATENT DOCUMENTS

| | | | |
|---|---|---|---|
| 2,953,526 | 9/1960 | Bergman et al. | 260/534 M X |
| 3,505,844 | 4/1970 | McLean | 72/42 |
| 3,523,895 | 8/1970 | Ishibashi et al. | 72/42 X |
| 3,726,799 | 4/1973 | McDole et al. | 72/42 X |
| 3,755,435 | 8/1973 | Sundby et al. | 260/534 M |
| 3,783,664 | 1/1974 | Tripathi | 72/42 |
| 3,966,619 | 6/1976 | Smith et al. | 252/49.3 X |

FOREIGN PATENT DOCUMENTS

| | | | |
|---|---|---|---|
| 1,191,114 | 5/1970 | United Kingdom | 252/49.3 |

*Primary Examiner*—Richard L. Raymond
*Attorney, Agent, or Firm*—Hammond & Littell

[57] ABSTRACT

Lubricants for the cold-working of aluminum and aluminum alloys applicable in aqueous solutions consisting of hydroxyalkyl-aminobutyric acids having the formula

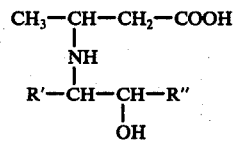

wherein R′ and R″ are members selected from the group consisting of hydrogen and alkyl having 1 to 20 carbon atoms with the proviso that the sum of carbon atoms in both R′ and R″ is from 6 to 20 and only one of R′ and R″ can be hydrogen; as well as aqueous preparations containing from 0.1 to 10% by weight of the hydroxyalkyl-aminobutyric acids and the method of cold-working aluminum and aluminum alloys employing the said aqueous preparation.

13 Claims, No Drawings

HYDROXYALKYL-AMINOBUTYRIC ACID LUBRICANTS FOR THE COLD-WORKING OF ALUMINUM

RELATED ART

In the cold-working, particularly in the cold-rolling of aluminum and aluminum alloys, lubricants are applied onto the rolls and on the aluminum or aluminum alloy pieces subjected to the rolling process. In general, these lubricants have two functions: (1) They must act as good heat transfer agents in order to eliminate the heat of deformation from the rolls, and (2) they must protect the surface of the rolled material from direct contact with the rolls.

Meeting these conditions is of particular importance in modern cold-rolling methods, but it is also particularly difficult. The increased production rates to be achieved with the modern cold-rolling equipment can be obtained by increasing the rolling speed and/or the percent of reduction in each passage. But both measures put higher demands on the lubricants. The high temperature at the roll gap, which can attain values of over 200° C, results in an deactivation of the additives contained in the roll lubricants, so that a satisfactory behavior of the roll lubricants is no longer ensured.

Three types of lubricants are used for the cold-working of aluminum and aluminum alloys. These three types are namely those based on mineral oils, an oil emulsions, and on aqueous solutions. Roll lubricants which are based on mineral oils or which consist mainly of mineral oils are at a disadvantage with respect to those lubricants based on water, as a heat transfer agent, since the specific heat of mineral oil is about half that of water. Furthermore, due to the possibility that the rolls will run hot at the high rolling speeds, there is a risk of fire when using mineral oil-based roll lubricants. Oil emulsions have a much greater cooling effect than mineral oil-based lubricants, but great difficulties occur during their filtration. Aqueous liquid cold-rolling lubricants do not have these drawbacks, and are for this reason in great demand, but they frequently tend to foam. Particularly annoying is the great stability of the foams formed. There is therefore a need for aqueous liquid cold-rolling lubricants with high heat transfer values, a good lubricating effect and a low tendency to foaming, or a low tendency to form stable foams.

OBJECTS OF THE INVENTION

An object of the present invention is the development of an aqueous preparation for use as a lubricant in the cold-rolling of aluminum and aluminum alloys which has a high heat transfer, a good lubricating effect and a low tendency to foaming.

Another object of the invention is the development of a hydroxyalkyl-aminobutyric acid for use in aqueous lubricant preparations in the cold-working of aluminum and aluminum alloys having the formula

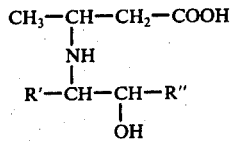

wherein R′ and R″ are members selected from the group consisting of hydrogen and alkyl having from 1 to 20 carbon atoms with the proviso that the sum of carbon atoms in both R′ and R″ is from 6 to 20 and only one of R′ and R″ can be hydrogen.

Another object of the present invention is the development of an aqueous preparation for use as a lubricant in the cold-working of aluminum and aluminum alloys consisting essentially of water containing from 0.1 to 10% by weight of a hydroxyalkyl-aminobutyric acid having the formula

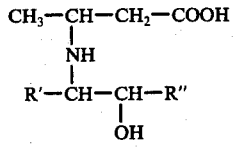

wherein R′ and R″ are members selected from the group consisting of hydrogen and alkyl having from 1 to 20 carbon atoms with the proviso that the sum of carbon atoms in both R′ and R″ is from 6 to 20 and only one of R′ and R″ can be hydrogen.

A yet further object of the present invention is the development of an improvement in the process of lubrication in the cold-working of aluminum and aluminum alloys consisting of using the above aqueous preparation lubricant.

These and other objects of the invention will become more apparent as the description thereof proceeds.

DESCRIPTION OF THE INVENTION

It has now been found that the drawbacks of the prior art have been overcome and the above objects achieved in that aqueous solutions with a content of hydroxyalkylaminobutyric acids of the general formula

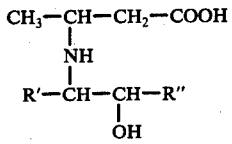

where R′ and/or R″ can represent hydrogen or an alkyl radical with 1 to 20 carbon atoms, but where R′ and R″ cannot denote hydrogen at the same time, and where the sum of the carbon atoms of R′ + R″ is 6 to 20, are particularly suitable for the cold-working of aluminum or aluminum alloys.

More particularly, the invention involves a hydroxyalkyl-aminobutyric acid for use in aqueous lubricant preparations in the cold-working of aluminum and aluminum alloys having the formula

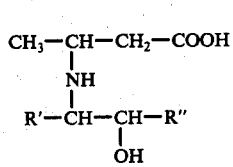

wherein R′ and R″ are members selected from the group consisting of hydrogen and alkyl having from 1 to 20 carbon atoms with the proviso that the sum of carbon atoms in both R′ and R″ is from 6 to 20 and only one of R′ and R″ can be hydrogen; as well as an aqueous preparation for use as a lubricant in the cold-working of aluminum and aluminum alloys consisting essentially of water containing from 0.1% to 10% by weight of a hydroxyalkyl-aminobutyric acid having the formula

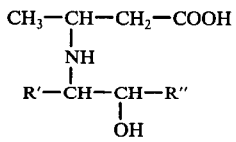

wherein R' and R'' are members selected from the group consisting of hydrogen and alkyl having from 1 to 20 carbon atoms with the proviso that the sum of carbon atoms in both R' and R'' is from 6 to 20 and only one of R' and R'' can be hydrogen.

Particularly suitable are aqueous solutions which contain hydroxyalkyl-aminobutyric acids where both R'and R'' in the above general formula represent hydrocarbon radicals; that is, products which are derived from non-terminal hydroxyamines.

These aqueous solutions yield an excellent thickness reduction of the metal parts during the rolling process, so that a good heat transfer from the metal and a good separation between rolling material and rolls are ensured, and any foam formed in the use of aqueous solution is less stable.

The production of the hydroxyalkyl-aminobutyric acids to be used according to the invention is effected by heating the corresponding hydroxyamines with crotonic acid in an aqueous solution for several hours. The aqueous concentrates formed can then be adjusted to the concentration of the aqueous lubricant solution by further dilution with water.

The hydroxyamines employed in the reaction with crotonic acid are those of the formula

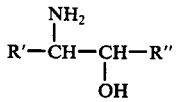

where R' and R'' have the above values, such as 2-hydroxyoctylamine, 2-hydroxydecylamine, 2-hydroxydodecylamine, 2-hydroxytetradecylamine, 2-hydroxyhexadecylamine, 2-hydroxyoctadecylamine, 2-hydroxyeicosylamine, 2-hydroxydocosylamine, but particularly non-terminal hydroxyalkylamines of the chain length of 8 to 22 carbon atoms, where the adjacent or vicinal position of amino group and hydroxyl group is distributed at random over the chain, with the exception of the 1,2-position.

The production of these hydroxyamines to be used for the reaction with crotonic acid can be effected in a technically satisfactory manner by epoxidation of the corresponding olefins and subsequent reaction of the epoxides with ammonia. When using olefins with an exclusive terminal olefin double bond, 2-hydroxyalkylamines are obtained but with the use of olefins with a non-terminal olefinic double bond, hydroxyalkyl amines, where the hydroxyl and amino groups in adjacent position are distributed at random over the molecule, are obtained.

Among the hydroxyalkyl-aminobutyric acids derived from the non-terminal hydroxyalkylamines, those which are particularly suitable are those derived from a non-terminal hydroxydodecylamine/hydroxytetradecylamine mixture, a nonterminal hydroxypentadecylamine/hydroxyhexadecylamine mixture, as well as mixtures by those hydroxyalkyl-aminobutyric acids in any ratio, but particularly in a mixture ratio of 1:1. These hydroxyalkyl-aminobutyric acid mixtures yield practically ideal cold-rolling liquids with excellent thickness reduction, a very good spread on the aluminum surfaces, and a very favorable foam behavior.

The hydroxyalkyl-aminobutyric acids of the invention are obtained by the reaction of the above hydroxyalkylamines with crotonic acid in an aqueous solution at elevated temperatures. The concentrations employed are such that, after heating the reaction mixture at temperatures up to the reflux for ½ hour to 10 hours, the hydroxyalkylaminobutyric acid is obtained in aqueous concentrates of from 45 to 60% by weight of the acid.

The hydroxyalkyl-aminobutyric acid can be recovered from these aqueous concentrates by the customary methods such as evaporation of the water under vacuum. However, for purposes of obtaining the aqueous lubricant preparations, the concentrates may simply be diluted with water.

The lubricants according to the invention for the cold-working of aluminum and aluminum alloys contain the hydroxyalkyl-aminobutyric acids in an amount of 0.1 to 10%, preferably 0.5 to 5% by weight, related to the entire aqueous lubricant.

The following examples illustrate the practice of the invention without being limitative in any respect.

EXAMPLES 1 to 6

First, about 55% aqueous concentrates of the hydroxyalkyl-aminobutyric acids to be tested were produced by reacting substantially equimolar amounts of corresponding hydroxyamines with crotonic acid in an aqueous solution.

1.
215.0 gm of an internal hydroxy-dodecyl-tetradecylamine (formed from aminating the epoxide of about a 1 to 1 mixture of non-terminal dodecene and tetradecene)
86.1 gm of crotonic acid
250.0 gm of water were heated for 10 hours with stirring to 100° C. When at the temperature of 100° C two liquid phases were formed, but on cooling to room temperature an about 55%, clear homogeneous solution was again obtained.

2.
200.0 gm of an internal hydroxy-pentadecyl-hexadecylamine (formed from aminating the epoxide of about a 1 to 1 mixture of non-terminal pentadecene and hexadecene)
59.1 gm of crotonic acid
212.0 gm of water were heated for 7 hours with stirring to 100° C.

In this case, two liquid phases were formed when hot, which remained, however in cooling. The solution obtained was about 55%.

3. This solution was obtained by mixing equal parts by weight of the above mentioned about 55% solutions of Examples 1 and 2.

4.
217.5 gm of 2-hydroxy-octyl-amine
129.0 gm of crotonic acid
285.0 gm of water were heated for 4 hours with stirring to 100° C. The about 55% aqueous solution obtained had two liquid phases.

5.
201.0 gm of 2-hydroxy-dodecyl-amine 86.0 gm of crotonic acid
235.0 gm of water
were heated for 4 hours with stirring to 100° C. An about 55% solution of hydroxy-dodecyl-aminobutyric acid was obtained, which had two liquid phases.

6.
215.0 gm of 2-hydroxy-dodecyl-tetradecylamine (about a 1 to 1 mixture)
86.0 gm of crotonic acid
250.0 gm of water
were heated for 10 hours with stirring to 100° C. The about 55% solution obtained had two liquid phases.

EXAMPLE 7

For the tests for thickness reduction and spreading capacity, aqueous solutions with 2% of the concentrates described above were made up; that is, with 1.1% of the respective hydroxyalkyl-aminobutyric acids. Clear to cloudy solutions were obtained, as it can be seen from Table I.

For the spreading capacity, the independent spreading of a drop of the solution on a degreased aluminum sheet was evaluated. The thickness reduction was determined according to Guminski and Willis (Journal of the Institute of Metals 1960, p. 481/82) by loading on aluminum strip wetted with a lubricant by means of a rectangular die. With a total load of 10 metric tons (t), the pressure is about 3 t/cm$^2$. With this method, the values for the individual products listed in Table I were obtained.

TABLE I

| Product of Example | 2% Solution Appearance | Spreading | Thickness Reduction In % |
|---|---|---|---|
| 1 | clear | very good | 61–65 |
| 2 | cloudy | very good | 60–68 |
| 3 | clear | very good | 70–76 |
| 4 | opalescent | good | 32–46 |
| 5 | opalescent | good | 47–56 |
| 6 | opalescent | good | 53–62 |

EXAMPLE 8

For testing the foam behavior, 50 ml of an aqueous solution with a content of 0.5% of the hydroxyalkyl-aminobutyric acids to be tested were shaken vigorously for 1 minute in a 500 ml shaking cylinder. The foam volume obtained was read immediately after shaking, after 1 minute, 5, 10 and 15 minutes. The foam volume values obtained are compiled in Table II.

TABLE II

| Product of Example | Foam volume in ml, minutes after shaking | | | | |
|---|---|---|---|---|---|
| | 0 | 1 | 5 | 10 | 15 |
| 1 | 115 | 80 | 60 | 35 | 25 |
| 2 | 130 | 90 | 85 | 75 | 50 |
| 3 | 130 | 90 | 75 | 50 | 40 |
| 4 | 115 | 80 | 60 | 35 | 25 |
| 5 | 50 | 30 | 20 | 20 | 15 |
| 6 | 40 | 30 | 25 | 20 | 10 |

As it can be seen from the test results, the lubricants according to the invention are characterized by good to very good spreading capacity, good to very good thickness reduction, and favorable foam disintegration values for any foaming which might occur during the cold-working process. This behavior makes them higly suitable as lubricants for the cold-working of aluminum and aluminum alloys, considering their incombustibility and good heat transfer.

The preceding specific embodiments are illustrative of the practice of the invention. It is to be understood, however, that other expedients known to those skilled in the art, or disclosed herein, may be employed without departing from the spirit of the invention or the scope of the appended claims.

I claim:

1. A hydroxyalkyl-aminobutyric acid for use in aqueous lubricant preparations in the cold-working of aluminum and aluminum alloys having the formula

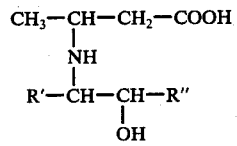

wherein R′ and R″ are members selected from the group consisting of hydrogen and alkyl having from 1 to 20 carbon atoms with the proviso that the sum of carbon atoms in both R′ and R″ is from 6 to 20 and only one of R′ and R″ can be hydrogen, and mixtures of said hydroxyalkyl-aminobutyric acids.

2. The hydroxyalkyl-aminobutyric acid of claim 1 wherein both R′ and R″ are alkyl.

3. The hydroxyalkyl-aminobutyric acid of claim 2 wherein the said acid is derived from a non-terminal hydroxydodecylamine/hydroxytetradecylamine mixture.

4. The hydroxyalkyl-aminobutyric acid of claim 2 wherein the said acid is derived from a non-terminal hydroxypentadecylamine/hydroxyhexadecylamine mixture.

5. The hydroxyalkyl-aminobutyric acid of claim 2 wherein the said acid is an approximately 1 to 1 mixture of acids derived from a non-terminal hydroxydodecylamine-hydroxytetradecylamine mixture and a non-terminal hydroxypentadecylamine/hydroxyhexadecylamine mixture.

6. Aqueous concentrates containing from 45 to 60% by weight of the hydroxyalkyl-aminobutyric acid of claim 1 in water.

7. An aqueous preparation for use as a lubricant in the cold-working of aluminum and aluminum alloys consisting essentially of water containing from 0.1 to 10% by weight of at least one hydroxyalkyl-aminobutyric acid having the formula

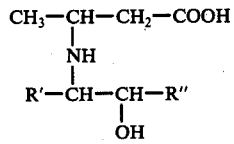

wherein R′ and R″ are members selected from the group consisting of hydrogen and alkyl having from 1 to 20 carbon atoms with the proviso that the sum of carbon atoms in both R′ and R″ is from 6 to 20 and only one of R′ and R″ can be hydrogen, and mixtures of said hydroxyalkyl-aminobutyric acids.

8. The aqueous preparation of claim 7 wherein both R′ and R″ are alkyl.

9. The aqueous preparation of claim 8 wherein the said acid is derived from a non-terminal hydroxydodecylamine/hydroxytetradecylamine mixture.

10. The aqueous preparation of claim 8 wherein the said acid is derived from a non-terminal hydroxypentadecylamine/hydroxyhexadecylamine mixture.

11. The aqueous preparation of claim 8 wherein the said acid is an approximately 1 to 1 mixture of acids derived from a non-terminal hydroxydodecylamine-hydroxytetradecylamine mixture and a non-terminal hydroxypentadecylamine/hydroxyhexadecylamine mixture.

12. The aqueous preparation of claim 7 containing from 0.5 to 5% by weight of said hydroxyalkylaminobutyric acid.

13. In the process of cold-working aluminum and aluminum alloys comprising shaping aluminum and aluminum alloys in the cold in the presence of a lubricant and recovering shaped material, the improvement consisting of using the aqueous preparation of claim 7 as said lubricant.

* * * * *